United States Patent [19]

Rollmann et al.

[11] 4,203,830

[45] May 20, 1980

[54] VISBREAKING PROCESS FOR DEMETALATION AND DESULFURIZATION OF HEAVY OIL

[75] Inventors: Louis D. Rollmann, Princeton, N.J.; Dennis E. Walsh, Richboro, Pa.

[73] Assignee: Mobil Oil Corporation, New York, N.Y.

[21] Appl. No.: 937,660

[22] Filed: Aug. 28, 1978

[51] Int. Cl.[2] ..... C10G 34/00; C10G 31/06; C10G 29/02

[52] U.S. Cl. ..... 208/236; 208/251 R

[58] Field of Search ..... 208/236, 251 R, 289, 208/298

[56] References Cited

U.S. PATENT DOCUMENTS

| | | | |
|---|---|---|---|
| 1,962,181 | 6/1934 | Egloff | 208/298 |
| 2,943,026 | 6/1960 | Pollock et al. | 208/251 R |
| 3,250,697 | 5/1966 | Walters et al. | 208/289 |
| 3,252,893 | 5/1966 | Mills | 208/251 R |
| 3,617,530 | 11/1971 | Rieve et al. | 208/289 |

*Primary Examiner*—George Crasanakis
*Attorney, Agent, or Firm*—Charles A. Huggett; Raymond W. Barclay

[57] ABSTRACT

A thermal demetalation and desulfurization process comprising the addition of ammonia and water to heavy crude oils and residuums with minimal coke formation and with decreased viscosity.

9 Claims, 1 Drawing Figure

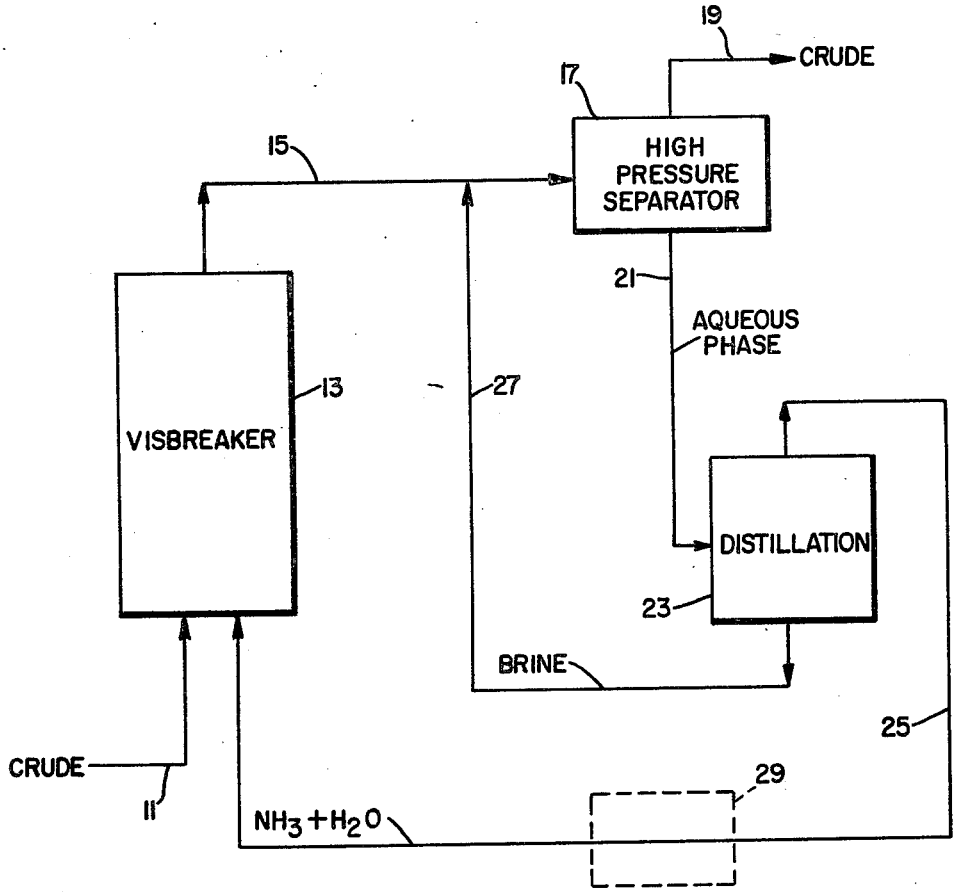
19
CRUDE
17
HIGH PRESSURE SEPARATOR
15
21
AQUEOUS PHASE
13
27
VISBREAKER
DISTILLATION
23
BRINE
25
CRUDE
11
29
$NH_3+H_2O$

VISBREAKING PROCESS FOR DEMETALATION AND DESULFURIZATION OF HEAVY OIL

BACKGROUND OF THE INVENTION

1. Field of the Invention

This invention relates to processes in which mild thermal cracking takes place in the presence of both steam and an added material and especially relates to such processes in which ammonia is added. It specifically relates to processes in which sulfur and deleterious metals are removed through a phase separation achieved by the injection of brine.

2. Description of the Prior Art

Visbreaking or viscosity-breaking is the name of an old thermal process for reducing the viscosity of crude oils and generally unsalable residues such as straight-run residuums for the purpose of decomposing the oil just enough to lower its viscosity and pour point so that it can be pumped more easily, without attempting to produce significant amounts of gasoline. It is generally a short-time decomposition which is conducted at low cracking temperatures at the heating-coil outlet, such as 800°-950° F. (443°-510° C.), so that liquid-phase cracking takes place at these low-severity conditions. In addition to the major product, fuel oil, material in the gas oil and the gasoline boiling range is produced. The gas oil may be used as additional feed for catalytic cracking units or as a heating oil.

U.S. Pat. No. 1,956,567 describes a watercycle aquolyzation process for visbreaking a heavy petroleum oil of the gas oil type with a large excess of water, such as 3:1 to 5:1 parts by weight of water:oil, at temperatures of 900°-1300° F. (482°-704° C.) and at pressures of 3,000-3,500 pounds per square inch to convert from one-half to three-fourths or more of the heavy oil to liquid hydrocarbons boiling below 430° F. or 450° F. (221° C. or 232° C.). The addition of ammonia or a mixture of ammonia and water is suggested for some stocks, catalytic material being additionally added to form amines or similar compounds that are useful in reducing engine knock. It also suggests that combination of ammonia with the components of the gas oil can be facilitated as desired by modifying temperatures and pressures.

U.S. Pat. No. 2,972,577 shows that a small quantity of pyridine added to Mara Western Venezuela crude before distillation causes substantially all of its vanadium content to be isolated in the distillation residue, apparently by rapidly forming a non-volatile pyridine-vanadium complex.

U.S. Pat. No. 3,132,085 teaches reducing the formation of heat-insulating, carbonaceous deposits on heat transfer surfaces that are contacted with thermally unstable hydrocarbon oils, such as alkylate gasoline or furnace oils, at temperatures of about 350° F. or more. Such reduction of deposits is obtained by adding a condensation product formed by condensing ammonium hydroxide, formaldehyde, and a monoalkylphenol having 4-12 carbon atoms in the alkyl substituent.

U.S. Pat. No. 3,293,314 discloses the use of ammonia to reduce coke lay-down on acidic oxide catalysts used for isomerization of alkyl aromatic hydrocarbons.

U.S. Pat. No. 3,380,909 discloses that an antifoulant additive to hydrocarbon streams, before liquid and/or vapor phase refinery processing, can substantially reduce the fouling of heat-exchanger surfaces. This antifoulant is obtained by reacting a polyalkylene amine with urea.

U.S. Pat. No. 3,773,651 discloses that in order to neutralize acidic components of curde oil it is general practice to introduce ammonia, morpholine or other basic reagents into the crude column overhead vapor line.

U.S. Pat. No. 3,819,328 describes the use of polyamines to control acid corrosion in petroleum distillation columns and compares them with ammonia and morpholine.

U.S. Pat. No. 4,062,764 discloses amines for neutralizing acidic components in the condensate obtained from distilling petroleum products and points out problems associated with the use of ammonia or morpholine.

U.S. Pat. No. 3,948,759 describes a visbreaking process for heavy hydrocarbon feed stocks, such as atmospheric and vacuum residua, heavy crude oils, and the like, to produce predominantly liquid hydrocarbon products of the motor fuel range, fuel oils, and lubricant base stocks by contacting these feed stocks in the presence of hydrogen with a regenerable alkali metal carbonate molten medium containing a glass-forming oxide, such as boron oxide, at a temperature up to about 1000° F. (538° C.) and at elevated pressures. It specifically teaches that metals can be deposited in the molten carbonates by cleavage of metalloporphyrins.

Various hydrocarbon charge stocks such as crude petroleum oils, topped crudes, heavy vacuum gas oils, shale oils, oils from tar sands, and other heavy hydrocarbon fractions such as residual fractions and distillates contain varying amounts of non-metallic and metallic impurities. Charge stocks derived from Mid-Continent, Louisiana, and East Texas crudes contain small amounts of metals. For example, some East Texas crudes contain about 0.1 part per million of vanadium and 2-4 parts per million of nickel. Charge stocks derived from West Texas crudes and foreign crudes, however, can contain larger amounts of metal. Kuwait crude can contain over 32 parts per million of vanadium and over 9 parts per million of nickel while Venezuelan crudes can contain 200-400 parts per million of vanadium and 17 to 59 parts per million of nickel.

The non-metallic impurities include nitrogen, sulfur, and oxygen and these exist in the form of various compounds and are often in relatively large quantities. The most common metallic impurities include iron, nickel, and vanadium. However, other metallic impurities including copper, zinc, and sodium are often found in various hydrocarbon charge stocks and in widely varying amounts. The metallic impurities may occur in several different forms as metal oxides or sulfides which are easily removed by single processing techniques such as by filtration or by water washing. However, the metal contaminants also occur in the form of relatively thermally stable organo-metallic complexes such as metal porphyrins and derivatives thereof along with complexes which are not completely identifiable and which are not so readily removed.

Such thermally stable organo-metallic complexes are high-boiling molecular structures that make up the residual portion of a crude oil, e.g., nickel or vanadium bound in a porphyrin structure. Hence, processing of residuas from certain fields is particularly hampered by their heavy metals content.

The presence of the metallic impurities in the hydrocarbon charge stocks causes much difficulty in processing of the charge stocks. The processing of the charge stock, whether the process is desulfurizing, cracking, reforming, isomerizing, or otherwise, is usually carried out in the presence of a catalyst and the metallic impurities tend to foul and inactivate the catalyst to an extent that may not be reversible. Fouling and inactivation of the catalyst are particularly undesirable where the catalyst is relatively expensive, as, for example, where the active component of the catalyst is platinum. Regardless of the cost of the catalyst, fouling and inactivation add to the cost of the processing of the charge stock and therefore are desirably minimized.

Thermal processing of the hydrocarbon charge stock can remove a portion of the metals. However, thermal processing results in conversion of an appreciable portion of the charge stock to coke, thus causing a loss of charge stock that desirably should be converted to a more economically valuable product or products. Moreover, by thermal processing, the metallic impurities tend to deposit in the coke with the result that the coke is less economically desirable than it would be in the absence of the metals.

Metals can also be removed by catalytic hydroprocessing of the charge stock. However, catalytic hydroprocessing results in the catalyst becoming fouled and inactivated by deposition of the metals on the catalyst. There is no convenient way of regenerating the catalyst and it ultimately must be discarded. Since these catalysts are relatively expensive, catalytic hydroprocessing to demetalize hydrocarbon charge stocks has not been economically practicable.

There is, consequently, a need for a process that will adequately reduce the molecular weight of a heavy crude and simultaneously remove metals therefrom, such as by splitting large hydrocarbon molecules and the metalloporphyrins combined therewith, in order to provide a wide variety of readily utilizable refinery charge stocks.

The present invention is mainly focused on cleavage of these complexes and removal of the metals while visbreaking and creating minimal coke formation.

SUMMARY OF THE INVENTION

It is accordingly an object of this invention to provide a process for at least partially removing deleterious metals and sulfur from well-head crudes, residua, and other heavy oils.

It is also an object to provide a process for controllably minimizing the formation of coke and reducing the viscosity therefrom.

It has surprisingly been discovered that by injecting minimum amounts of ammonia in aqueous solution into a visbreaking process, it is possible to minimize coking, increase viscosity reduction, and partially remove both nickel and vanadium in addition to sulfur from a heavy crude oil.

The invention generally comprises the addition, as by injection, of from 0.1 to 15 parts by weight of an ammonia solution to one hundred parts of oil, the ammonia solution containing from 0.5 to 30% by weight of $NH_3$. The ammonia solution may be at the same temperature as the oil or at a higher temperature but is preferably at a high enough temperature that by admixture with the oil no passage through a heat exchanger is necessary to effect the desired reaction. The amount of water employed will be within the range of 0.1:1 to 5:1 parts of water per part of oil and is normally in the range of 1:1.

In general, the amount of ammonia should be substantial and in excess of 1% by weight of the oil being treated. Visbreaking operating temperatures of 750°-1100° F. (427°-593° C.) and 50-5000 psig are suitable. The preferred ranges are 800°-900° F. (438°-582° C.) and 900-1200 psig. The preferred time of exposure to high temperature is one minute to 8½ hours. The reaction between ammonia and hydrocarbon feed stock should be carried out for a period of time sufficient to render metals and sulfur contained therein extractable when phase separation is subsequently achieved by the injection of brine solution. After reaction, the mixture of oil and water is quickly cooled to a phase separation temperature of 400°-550° F. (204°-288° C.). The phase separation is preferably done at operating pressures after an injection of 10 to 100% by weight (NaCl) brine solution.

The hydrocarbon product of reduced viscosity is sent to further refining operations, and the aqueous phase is distilled in order to separate brine from the ammonia solution. Heavy metals remain in the brine solution and are periodically removed from the process by discarding thereof.

More specifically, the heavy hydrocarbon feed stocks of the instant invention are whole crude petroleum oils, topped crude oils, heavy residua, atmospheric and vacuum residua, crude bottoms, pitch, asphalt, other heavy hydrocarbon pitch-forming residua, refinery feed stocks such as reduced crudes. Such hydrocarbon feed stocks may be obtained from petroleum, shale oil kerogen, tar sands bitumen processing, synthetic oils, coal hydrogenation, and the like. Preferably these hydrocarbon feed stocks are crude oils, aromatic tars, and atmospheric or vacuum residua, at least a portion of which boil above about 650° F. (343° C.) at atmospheric pressure.

BRIEF DESCRIPTION OF THE DRAWING

The drawing is a schematic representation of a preferred embodiment of the process of this invention.

DESCRIPTION OF THE PREFERRED EMBODIMENT

Experiments were run with a Melones crude containing 0.59% nitrogen, 3.94% sulfur, 94 ppm nickel, and 375 ppm vanadium and having a kinematic viscosity at 54° C. of 2,990 cps. This crude was run through the process equipment shown in the drawing in a series of runs. Following the same procedure for each run, crude stream 11 and aqueous stream 25 were fed to visbreaker 13 and heated therein at a selected temperature and pressure, stream 15 was removed and sent to a high-pressure separator 17 where it was combined with a brine solution, viscosity-lowered crude 19 was removed therefrom, and aqueous phase 21 was sent to distillation column 23 from which brine bottoms 27 were removed and circulated back to stream 15, and aqueous overhead stream 25 was returned to visbreaker 13.

Preferably crude 11 is preheated to a temperature at which fouling of the heat-exchange surfaces does not occur, and the ammonia-plus-water stream 25 is heated to a high temperature, such as 1,200° F. (649° C.), in heat exchanger 29 and then mixed with crude 11 within visbreaker 13. Another successful means of avoiding such fouling is the addition of an amine, as a partial substitute for the ammonia, into crude stream 11 before it enters the heat exchanger, this amine being chosen both for its visbreaking usefulness and for its anti-fouling qualities.

The invention may be more clearly understood by consideration of the following examples, in which visbreaker 13 is an up-flow, vycor-packed reactor chamber having a free volume of 10 cc and in which high-pressure separator 17 is sufficiently large to allow the crude and aqueous phases to form a clear separation.

EXAMPLE 1

Melones crude at 80 cc/hr was fed as crude stream 11 to visbreaker 13, and an aqueous treating solution containing 0.2% $H_2S$ (0.07 M) was simultaneously fed as stream 25 to visbreaker 13 and therein both streams were mixed and heated to the operating temperature of 842° F. (450° C.) under 1000 psig. After about 260 seconds of passage through visbreaker 13, the mixed stream of crude and aqueous solution was fed to high-pressure separator 17 and therein separated into crude 19 and aqueous phase 21 at a separator temperature of 250° C. (482° F.). It produced a coke yield, as shown in the accompanying table, of 3.3%, but its kinematic viscosity could not be measured because it produced an emulsion.

| Run No. | Additive | Coke Yield % | Kinematic Viscosity cps | Metals Removal, % Ni | V | S |
|---|---|---|---|---|---|---|
| 1 | 0.2% $H_2S$ (0.07M) | 3.3 | emulsion | | | |
| 2 | $H_2O$ | 0.61 | 410 | 12 | 13 | 5 |
| 3 | 1.1% $(NH_4)_2S$ (0.2M) | 0.3 | — | 27 | 27 | 15 |
| 4 | 0.7% $NH_3$ (0.4M) | 0.27 | 180 | 26 | 20 | 14 |
| 5 | 14% $NH_3$ | — | — | 34 | 24 | 8 |

EXAMPLE 2

The process of Example 1 was repeated except that process stream 25 was pure water. The coke yield was 0.61%, and the kinematic viscosity of crude stream 19 was 410 cps at 54° C. Analysis of crude 19 showed that 12% of the nickel, 13% of the vanadium, and 5% of the sulfur in the Melones crude had been removed by treatment with water only.

EXAMPLE 3

The process of Example 1 was repeated with aqueous stream 25 being a 1.1% solution of $(NH_4)_2S$ (0.2 M). The coke yield was 0.3%.

EXAMPLE 4

The process of Example 1 was again repeated in which aqueous stream 25 was a 0.7% solution of ammonia (0.4 M $NH_3$). The coke yield was 0.27% and the kinematic viscosity of crude stream 19 was 180 cps at 54° C.

EXAMPLE 5

The process of Example 1 was repeated in which aqueous stream 25 was a 14% solution of $NH_3$ (7.5 M). Analysis of crude stream 19 showed that 34% of the nickel, 24% of the vanadium, and 8% of the sulfur had been removed by the visbreaking operation, as given in the table. Thus ammonia is nearly three times as effective as pure water with respect to removing nickel and nearly twice as effective as pure water with respect to removing vanadium from a crude.

The examples provided hereinbefore unambiguously identify a beneficial role for ammonia in mild thermal processing (visbreaking) of heavy hydrocarbon feed stocks with respect to quenching an undesirable acid-catalyzed path to coke, reducing viscosity of the feed stock, and removing deleterious amounts of sulfur and heavy metals.

Because it will be readily apparent to those skilled in the art that innumerable variations, modifications, applications, and extensions of examples and principles hereinbefore set forth can be made without departing from the spirit and scope of the invention, what is herein defined as such scope and is desired to be protected should be measured, and the invention should be limited, only by the following claims.

What is claimed is:

1. A visbreaking process for demetalation and desulfurization of a heavy hydrocarbon feed stock which comprises contacting said stock with an aqueous solution of 0.5 to 30 weight percent ammonia at visbreaking temperature and recovering a hydrocarbon product from said contacting having a reduced viscosity which is at least partially demetalized and desulfurized.

2. A visbreaking process for demetalation and desulfurization of a hydrocarbon feed stock which comprises contacting said feed stock with an aqueous solution of 0.5 to 30 weight percent ammonia in a reaction zone maintained under a temperature of 427° to 593° C. and a pressure of 50–5000 psig; removing an overhead hydrocarbon stream from said zone and contacting said stream in a separation zone with an aqueous solution of salt to separate an aqueous phase containing ammonia, water and salt, from the hydrocarbon oil phase having a reduced viscosity which is at least partially demetalized and desulfurized.

3. The method of claim 1 or 2 wherein the amount of ammonia solution ranges from 0.1 to 15 parts per one hundred parts of oil.

4. The method of claim 2 wherein the aqueous phase is distilled to recover an aqueous stream of ammonia.

5. The method of claim 2 wherein the aqueous phase is distilled to recover an aqueous stream of salt.

6. The method of claim 4 wherein said aqueous stream is recycled to the reaction zone.

7. The method of claim 5 wherein said aqueous stream is recycled to the separation zone.

8. The method of claim 7 wherein said separation zone is maintained at contacting pressure.

9. The method of claim 8 wherein the contacting pressure of said aqueous ammonia solution additionally produces a reduced coke yield as compared to operation of said thermal process without said aqueous ammonia solution.

* * * * *